United States Patent [19]

Faber

[11] Patent Number: 4,765,270

[45] Date of Patent: Aug. 23, 1988

[54] DECORATIVE COATING MACHINE

[75] Inventor: Elmer L. Faber, Temperance, Mich.

[73] Assignee: Deco Tools, Inc., Toledo, Ohio

[21] Appl. No.: 97,133

[22] Filed: Sep. 16, 1987

[51] Int. Cl.[4] ..... B05C 11/02

[52] U.S. Cl. ..... 118/102; 118/106; 118/109; 118/319; 118/323

[58] Field of Search ..... 118/102, 106, 109, 319, 118/323

[56] References Cited

U.S. PATENT DOCUMENTS

| | | | |
|---|---|---|---|
| 1,915,642 | 6/1933 | Arbuckle et al. . | |
| 2,374,356 | 4/1945 | Keuffel et al. . | |
| 2,878,139 | 3/1959 | Way et al. | 118/319 X |
| 2,888,903 | 6/1959 | Faber | 118/323 X |

FOREIGN PATENT DOCUMENTS

| | | |
|---|---|---|
| 54-156058 | 12/1979 | Japan . |
| 58-132059 | 8/1983 | Japan . |

*Primary Examiner*—John P. McIntosh

*Attorney, Agent, or Firm*—Emch, Schaffer, Schaub & Porcello Co.

[57] ABSTRACT

A decorative coating machine is disclosed. The machine includes a rotary work table having workpiece fixtures mounted on its periphery. A spray gun assembly is positioned adjacent the work table for applying paint to the workpieces. A wiping assembly is also positioned adjacent the work table periphery and includes a web of wiping material which travels along a path defined by a plurality of horizontal rollers. Solvent is applied to the web of wiping material. As the painted workpieces travel below the rollers, a predetermined area of paint is removed from the workpieces mounted on the fixtures.

13 Claims, 5 Drawing Sheets

DECORATIVE COATING MACHINE

BACKGROUND OF THE INVENTION

The decorative painting of various items is a well established art. In the automotive industry, decorative painting is used on several items including, for example, the decorative strips which show the trademark of the individual vehicle. Often, these strips have a chrome-like appearance. Portions of the letters are sometimes decoratively painted to give the necessary highlights for the aesthetics desired. Normally in the prior art, a decorative mask is cut and placed over the workpiece to be painted. The decorative mask prevents paint from being applied to, for example, the upper chrome-like surfaces, while at the same time allowing the paint to be deposited on preselected painted portions of the workpiece.

The producing of decorative masks and their use in a high volume operation is relatively expensive. The mask must be produced, installed, cleaned and replaced on a periodical basis.

SUMMARY OF THE PRESENT INVENTION

The decorative painting machine, according to the present invention, allows precise decorative painting without the necessity of a decorative painting mask.

A motor driven rotary work table has a plurality of circumferentially spaced fixtures mounted adjacent its periphery. Preferably the workpiece fixtures have raised portions which mate with and are complementary with workpieces to be painted. A painting assembly is positioned adjacent the periphery of the rotatable work table. One or more spray guns paint the entire top and side surfaces of the workpiece. For example, a workpiece having a chrome-like outer surface is painted. The paint covers not only the selected area where paint is desired on the final product, but also the upper surface where paint is not desired and where the chrome surface is desired.

After leaving the painting station, the workpiece is passed through a wiping assembly which includes a plurality of horizontally mounted rollers adjacent the periphery of the work table. The rollers define a path for a web of wiping material. The wiping material travels along the path and at one or more roller locations passes through a solvent tray. As the painted workpieces pass below the series of rollers, wiping material with solvent applied removes the paint from the predetermined areas. As the same workpiece continues its movement through the wiping station, another roller having web material with solvent applied gives a secondary wipe while remaining rollers having dry wiping material around their circumferences polish the upper surface and enhance, for example, a chrome-like final surface.

It has been found that a decorative painting machine, according to the present invention, is most efficient in the high volume decorative painting of workpieces.

DESCRIPION OF THE PREFERRED EMBODIMENT

Figure 1:
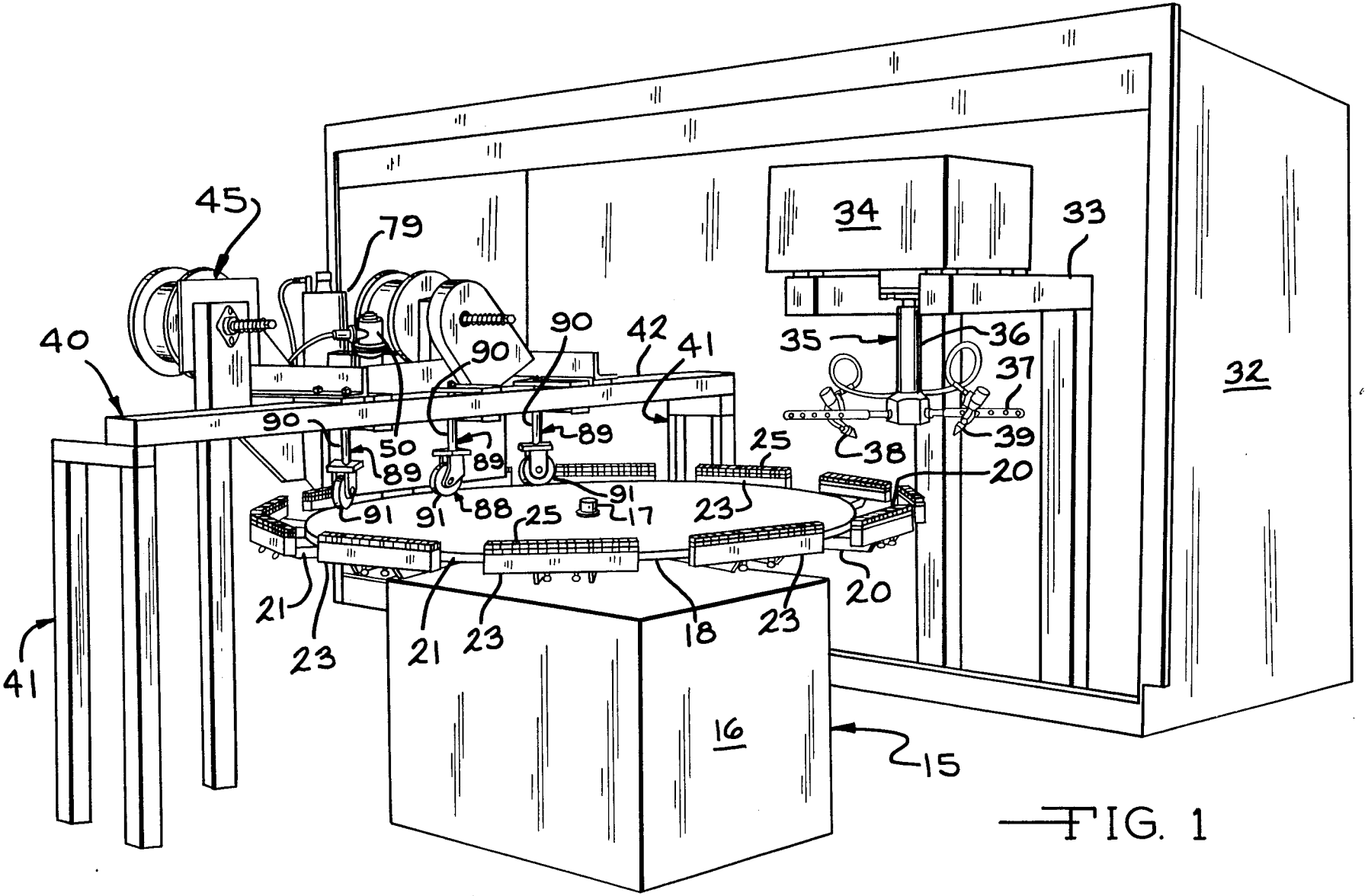
FIG. 1 is a perspective view of a decorative coating machine, according to the present invention.
Figure 2:
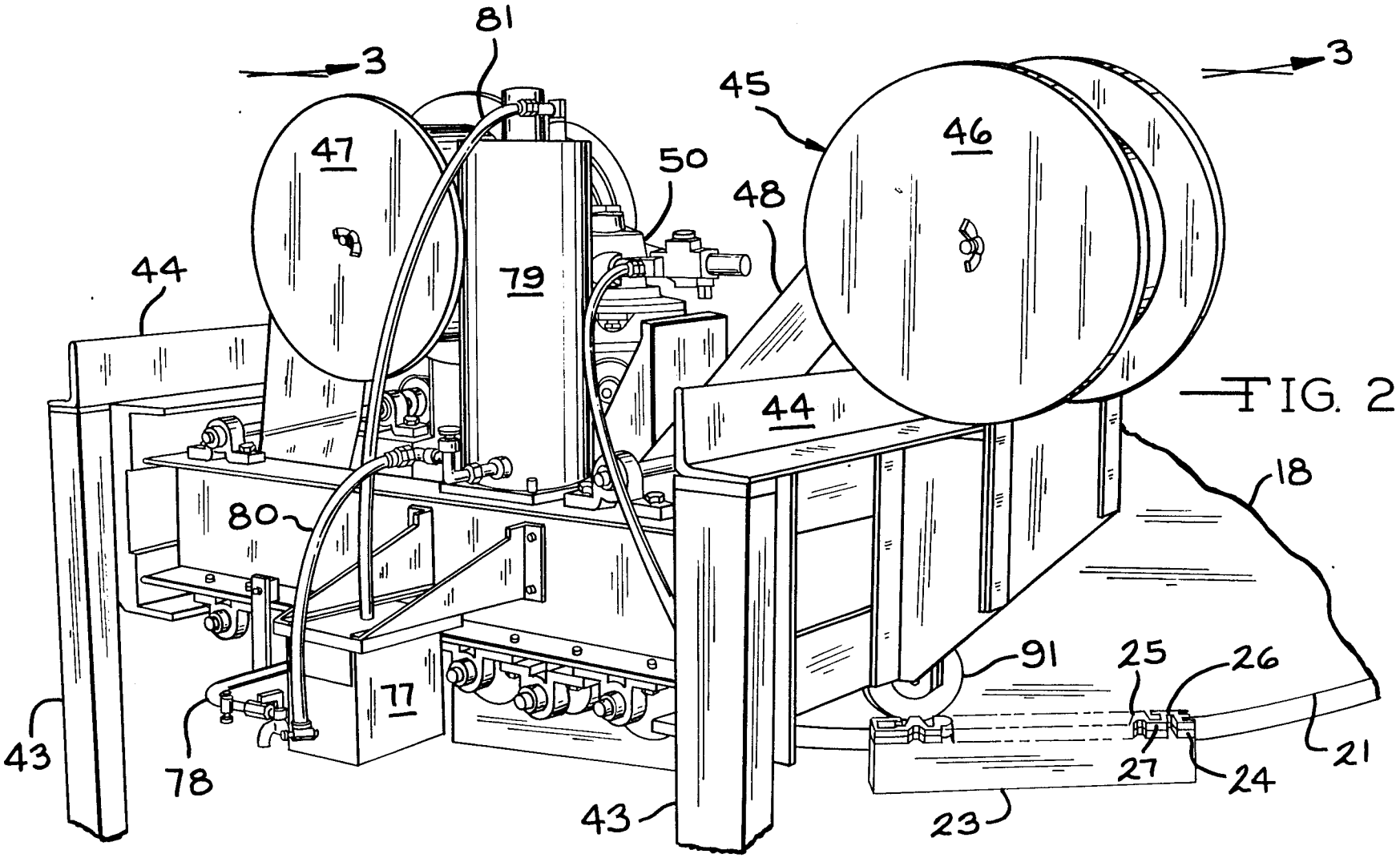
FIG. 2 is an enlarged, fragmentary perspective view showing a portion of the decorative coating machine including the wiping assembly.

A decorative coating machine, according to the present invention, is indicated by the reference number 15 in FIG. 1. The decorative coating machine 15 includes a base 16. A motor and gear box assembly includes an output shaft 17 which mounts a rotary work table 18. A plurality of arms 20 extend radially outwardly from the periphery 21 of the rotary work table 18.

Figure 8:
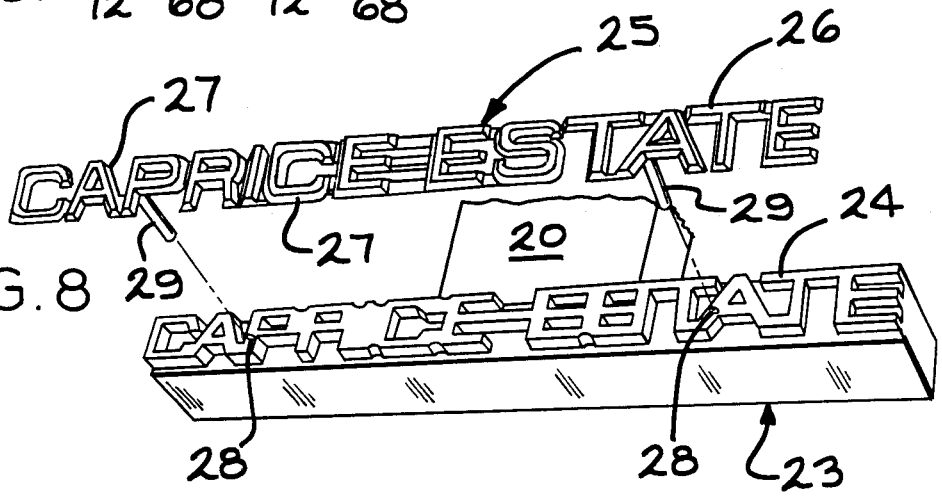
FIG. 8 is an exploded view of a workpiece fixture, showing a workpiece positioned above the fixture.

Workpiece fixtures 23 are mounted on the outer ends of the arms 20. Referring to FIG. 8, the workpiece fixtures 23 include raised support members 24 which mate with and are complementary with a workpiece 25. In the present embodiment, the workpiece 25 is a nameplate for a vehicle. The workpiece 25, as it is placed on the fixture 23 includes a chrome-like upper surface 26 and chrome-like side surfaces 27. The raised support member 24 of the workpiece 25 defines openings 28 which index and receive depending posts 29 of the workpiece 25.

Referring to FIG. 1, a paint spray booth 32 is mounted adjacent the rotary work table 18. A frame 33 is mounted within the booth 32 and supports a motor drive mechanism 34. A spray painting assembly 35 includes a rotatable shaft 36 and a horizontal cross arm 37. The drive mechanism 34 rotates the shaft 36 and the cross arm 37. In the present embodiment, a pair of spray guns 38 and 39 are mounted on the cross arm 37 and apply paint to the upper surfaces 26 and side surfaces 27 of the workpieces 25 as they pass below the spray painting assembly 35.

Referring to FIG. 1, a wiping assembly framework is generally indicated by the reference number 40. The framework 40 includes side assemblies 41 and a main horizontal beam 42. Vertical legs 43 are spaced from the main horizontal beam 42. Horizontal channel members 44 are connected to and extend between the legs 43 and the main beam 42. The wiping assembly framework 40 mounts a wiping assembly generally indicated by the reference number 45. The wiping assembly 45 includes a supply roll 46 and a take-up roll 47. A web of wiping material 48 is delivered from a supply roll 46 and along a path defined by a plurality of rollers 49 and 58 (see FIG. 3).

Figure 4:
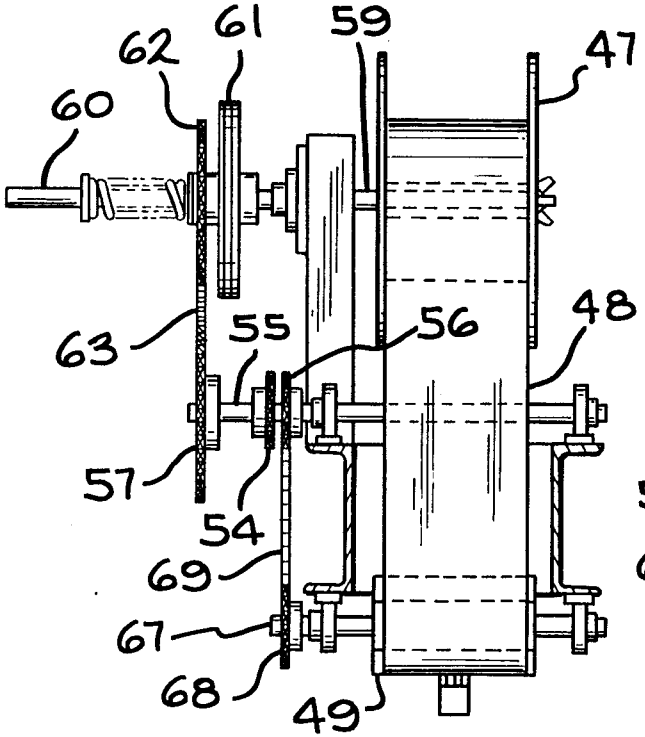
FIG. 4 is a fragmentary sectional view taken along line 4—4 of FIG. 3.
Figure 7:
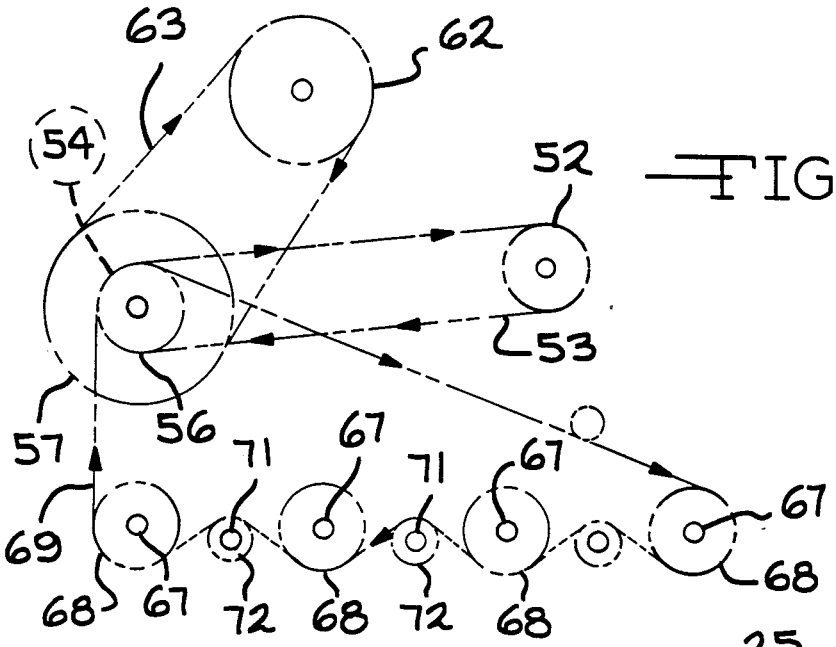
FIG. 7 is a diagrammatic view showing the drive chains for the wiping rollers and for the take-up roller.

The take-up roll 47 is driven by an air motor 50 operatively connected to a gear reduction box 51 and an output sprocket 52. A chain 53 is positioned on the output socket 52 and extends around a sprocket 54 mounted on a shaft 55. Referring to FIG. 4, the shaft 55 also mounts sprockets 56 and 57. The take-up roll 47 is mounted on a shaft 59 which is engaged with a mating shaft 60 through a friction clutch 61. The friction clutch 61 ensures proper tension on the web of wiping material 48. A sprocket 62 is mounted on the shaft 60 and a drive chain 63 extends between the sprockets 57 and 62.

The web wiping material 48 may be an absorbent paper, having the strength to absorb solvent and also wipe the top of a workpiece to remove paint. However, other types of absorbent web materials may also be utilized.

Figure 3:
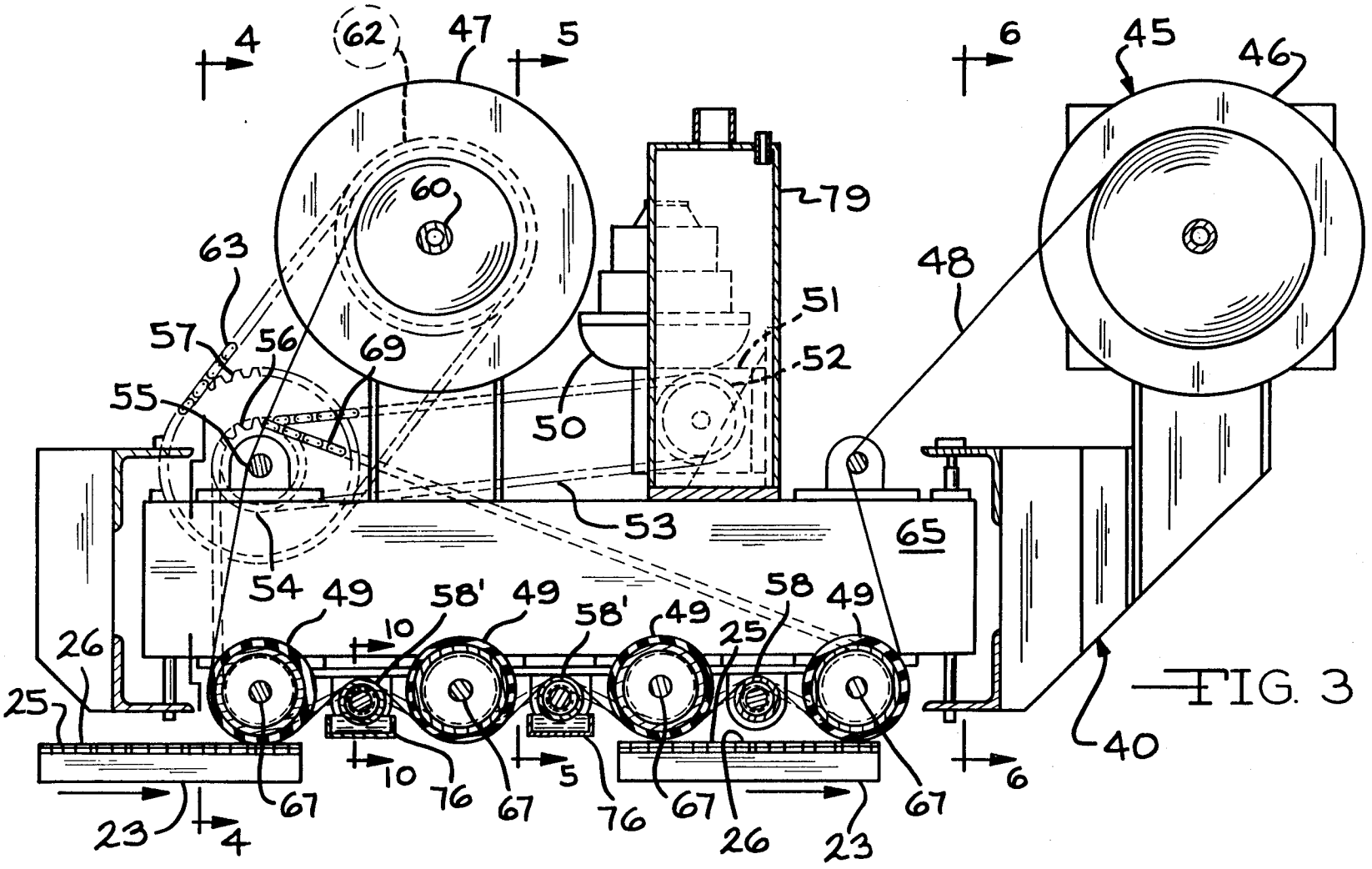
FIG. 3 is a fragmentary sectional view taken approximately along the line 3—3 of FIG. 2.
Figure 10:
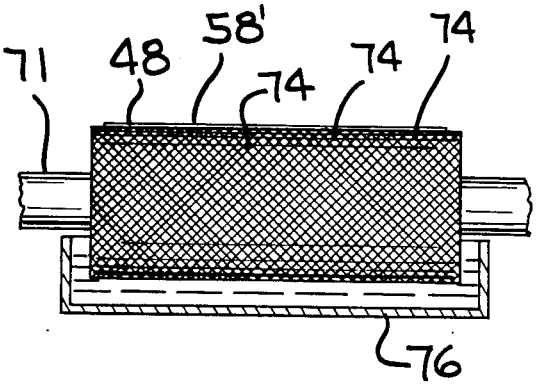
FIG. 10 is a fragmentary sectional view of a solvent roller.

Referring to FIG. 3, a pair of cross beams 65 are mounted for vertically adjustable movement with respect to the wiping assembly framework 40. In turn, the vertically adjustable cross beams 65 rotatably mount the rollers 49 and 58 in a horizontal position. Each of the rollers 49 includes a shaft 67 and a sprocket 68. Referring to FIG. 4, a drive chain 69 extends between the sprocket 56 mounted on the shaft 55 and the sprockets 68 mounted on the shaft 67. The chain 69 drives the rollers 49. Similarly, the rollers 58 are mounted on shafts 72 having drive sprockets 72. The drive chain 69 also drives the sprockets 72, the shafts 71 and the rollers 58 mounted thereon. As shown in FIG. 10, the rollers 58 include an outer periphery which has a plurality of openings 74 for picking up solvent and transporting the solvent to the web of wiping material 48. In the present embodiment, the roller 58 is a metal roller having a knurled surface which defines the openings 74.

Figure 9:
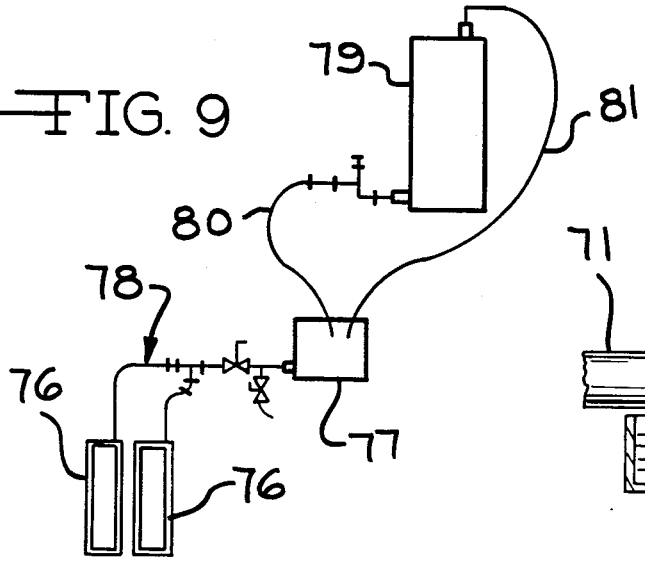
FIG. 9 is a diagrammatic view of the solvent supply system.

Referring to FIG. 3 and 9, a pair of solvent trays 76 are positioned below and in contact with the two solvent rollers 58'. The solvent trays 76 are filled with a paint solvent. One example of a solvent is VM & P Naptha. However, other types of aromatic hydrocarbon solvents or other solvents may be utilized. The solvent trays 76 are supplied with solvent from a solvent holding tank 77 which is connected by a conduit and valve system 78 to the trays 76. Solvent is supplied to the holding tank 77 from a main solvent supply tank 79 having a supply conduit 80 and a return conduit 81.

Figure 6:
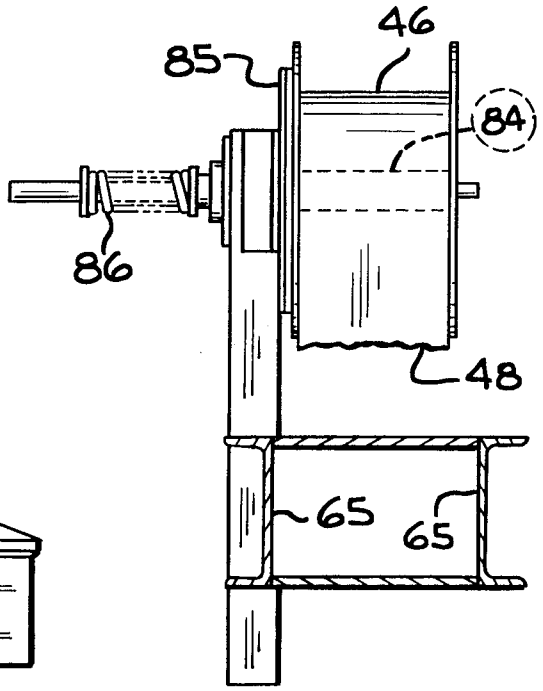
FIG. 6 is a fragmentary sectional view taken along line 6—6 of FIG. 3.
Figure 5:
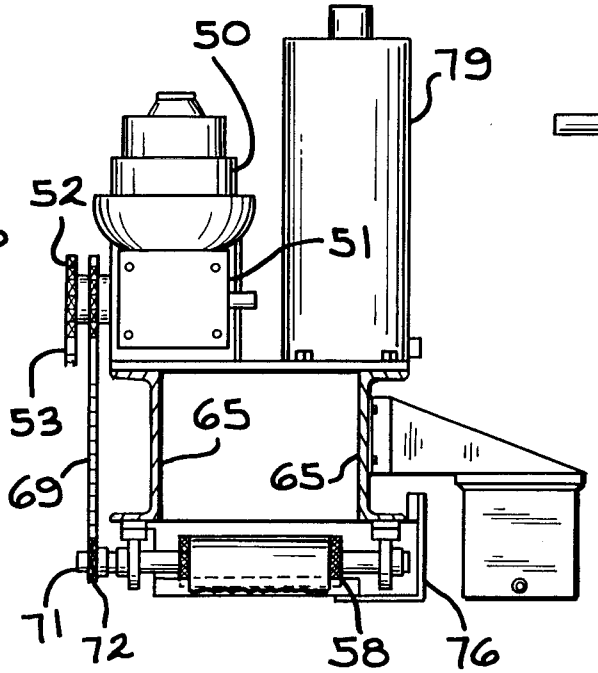
FIG. 5 is a fragmentary sectional view taken along line 5—5 of FIG. 3.

Referring to FIG. 6, the supply roll 46 is mounted on an idler shaft 84. A friction plate assembly 85, including spring biasing means 86, places the proper amount of tension on the supply roll 46. In the present embodiment, the supply roll 46 is not driven. Rather, the supply roll 46 rotates in response to rotation of the power take-up roll 47 and the resultant movement of the web of wiping material 48.

Referring to FIG. 1, spacer means 88 are operatively connected between the wiping assembly framework 40 and the periphery 21 of the rotary work table 18 for maintaining correct vertical alignment of the outer surfaces of the rollers 49 relative to the upper surfaces 26 of the workpieces 25. As shown in FIG. 3, this vertical relationship between the wiping surface of the rollers 49 and the upper surface 26 of the workpiece 25 is most important. In the present embodiment, the spacer means 88 comprises three pressure roller assemblies 89 having vertical arms 90 operatively attached to the framework 40 and having pressure rollers 91 rotatably mounted at their lowest ends. The pressure rollers 91 are in engagement with the periphery 21 of the rotary work table 18.

Referring to FIG. 3, as the web of wiping material 48 leaves the supply roll 46 it first passes around the right hand roller 49. Each of the rollers 49 has an outer neoprene cushion layer to ensure that proper pressure is placed on the web of wiping material 48 as it engages the upper surface 26 of the workpiece 25. In the current embodiment, the two right hand rollers 49 are polishing rollers. After the wiping material passes from the right hand roller 49 it passes around an idler roller 58 and then around the second roller 49. Because the workpieces 25 are moving in the direction indicated by the arrows in FIG. 3, the final polishing step given by the right hand roller 49 is done with clean wiping material 48. As the final polish is completed by the right hand roller 49, the used web of wiping material 48 continues towards the left and passes under the second polishing roller 49. Next it passes through the second solvent tank 76 and finally around the left hand roller 49 which is also a paint removal roller. The dirtied wiping material 48 then moves upwardly to the take-up roll 47.

Under the method fo the present invention, workpieces 25 are initially positioned within the workpiece fixtures 23. The work table 18 is rotated beneath the spray guns 38 and 39 where paint is placed on both the upper surface 26 and side surfaces 27 of the workpieces 25. It is understood that in the final product while the paint is desired on the side surfaces 27, no paint is desired on the upper surface 26. Referring to FIG. 3, to remove the paint from the upper surface 26, the rotary work table continues movement, wherein the upper surface 26 is solvent wiped by the left hand roller 49. As the workpieces 25 continue their movement, they are solvent wiped by the second roller 49 and then pass beneath the two right hand polishing rollers 49. Finally, the completed workpieces 25 are removed from the fixtures 23 and the cycle repeated.

It has been found that the decorative coating machine 15 provides a very efficient means for decoratively painting workpieces.

Many modifications and revisions may be made to the decorative coating machine 15, described above, without departing from the scope of the following claims.

What I claim:

1. A decorative coating machine for use in painting workpieces comprising, in combination, a rotary work table having a plurality of fixtures for receiving such workpieces mounted adjacent its periphery, a spray painting assembly mounted adjacent the periphery of said rotary work table, wherein such workpieces are painted by said spray painting assembly and a wiping assembly positioned adjacent the periphery of said work table for removing a predetermined area of paint from each of said workpieces, said wiping assembly including supply means for supplying a web of wiping material, at least one solvent means positioned adjacent said wiping material for applying solvent to said wiping material and roller means adjacent the periphery of the work table and adjacent the workpiece fixtures, said roller means defining a path for said web of wiping material.

2. A decorative coating machine, according to claim 1, including a frame mounting said roller means and spacer means operatively connected between said frame and such periphery of said work table for maintaining vertical alignment of said roller means relative to said workpiece fixtures.

3. A decorative coating machine, according to claim 1, wherein said spray painting assembly includes a rotatable shaft positioned above said periphery of said rotary work table, a cross arm mounted adjacent the lower end of said rotatable shaft and at least one paint spray gun mounted on said cross arm directed toward said work table periphery and such workpiece fixtures.

4. A decorative coating machine, according to claim 1, wherein said wiping assembly includes a supply roll and a take-up roll, said web of wiping material mounted on and extending between said supply and take-up rolls and drive means for rotating one of said rolls.

5. A decorative coating machine, according to claim 4, wherein said roller means comprises a plurality of rollers and wherein said web material passes around said rolls, at least one of said rollers having its surface adjacent said solvent means.

6. A decorative coating machine, according to claim 5, wherein said roller having its surface adjacent said solvent means has a knurled surfaced which tends to hold solvent and wherein said solvent means comprises a solvent tray.

7. A decorative coating machine, according to claim 5, including a solvent supply tank in communication with said solvent means.

8. A decorative coating machine, according to claim 4, including a friction means operatively connected to at least one of said rolls for adjusting tension on said web of wiping material.

9. A decorative coating machine, according to claim 1, wherein each of said workpiece fixtures is mounted on an arm extending radially outwardly from said work table, said workpiece fixture including a support surface complementary with such workpiece including raised portions corresponding to such workpiece, whereby said raised portions support such workpiece in an elevated position to insure the painting of the side edges of such workpieces as the workpiece travels past the spray painting assembly.

10. A decorative coating machine for use in painting workpieces comprising, in combination, a rotary work table having a plurality of workpiece fixtures for receiving such workpieces mounted adjacent its periphery, each of said workpiece fixtures including a raised portion complementary with such workpieces, a spray painting assembly mounted adjacent the periphery of said rotary work table for painting workpieces mounted on said workpiece fixtures, a plurality of horizontally mounted rollers mounted adjacent to said periphery of said rotary work table, a web of wiping material positined along a path defined by said rollers and solvent means for applying solvent to said web of wiping material, whereby a predetermined area of paint is removed from a painted workpiece by such solvent on said web of wiping material.

11. A decorative coating machine according to claim 10, including a supply reel and a take-up reel for said web of wiping material and drive means for driving one of said reels.

12. A decorative coating machine according to claim 10, wherein said solvent means includes at least one solvent tray adjacent one of said rollers and a solvent supply tank in liquid communication with said solvent tray.

13. A decorative coating machine, according to claim 12, wherein said roller mounted adjacent said solvent tray has an irregular surface defining openings for receiving solvents and transferring solvent to said web of wiping material.

* * * * *